US006161936A

United States Patent [19]

Sato

[11] Patent Number: 6,161,936

[45] Date of Patent: Dec. 19, 2000

[54] PORTABLE LIGHTING DEVICE

[76] Inventor: Giichiro Sato, 5-9, Nishi-Tsutsujigaoka 2-chome, Chofu-shi, Tokyo, Japan

[21] Appl. No.: 08/917,356

[22] Filed: Aug. 26, 1997

[30] Foreign Application Priority Data

Apr. 10, 1997 [JP] Japan ..... 9-003274
Jul. 16, 1997 [JP] Japan ..... 9-006761

[51] Int. Cl.[7] ..... F21V 9/16

[52] U.S. Cl. ..... 362/84; 362/186; 362/202

[58] Field of Search ..... 362/186, 202, 362/205, 84, 208; 250/458.1

[56] References Cited

U.S. PATENT DOCUMENTS

| | | | |
|---|---|---|---|
| 4,114,187 | 9/1978 | Uke | 362/158 |
| 4,210,953 | 7/1980 | Stone | 362/189 |
| 4,527,223 | 7/1985 | Maglica | 362/186 |
| 4,528,621 | 7/1985 | Hoyt | 362/189 |
| 4,546,416 | 10/1985 | Pemberton | 362/84 |
| 5,347,438 | 9/1994 | Lerner | 362/186 |
| 5,654,552 | 8/1997 | Toombs | 362/84 |
| 5,690,414 | 11/1997 | Jeng | 362/120 |
| 5,757,111 | 5/1998 | Sato | 313/111 |
| 5,833,349 | 11/1998 | Apple | 362/84 |
| 5,893,629 | 4/1999 | Gubernick | 362/186 |

*Primary Examiner*—Cassandra Spyrou
*Assistant Examiner*—Mark A. Robinson
*Attorney, Agent, or Firm*—McDermott, Will & Emery

[57] ABSTRACT

According to one aspect of the present invention, a portable lighting device is provided, which comprises a battery casing, a miniature lamp mounted near an end of the battery casing, and a shielding plate arranged at a position separated from the miniature lamp in axial direction of said battery casing, said shielding plate being made of a semi-transparent material and containing a light storing material. According to another aspect of the present invention, a portable lighting device is provided, which comprises a battery casing, a miniature lamp mounted near an end of the battery casing, and a cylindrical member extended from the end of the battery casing where the miniature lamp is mounted in axial direction of the battery casing, disposed to shield front side and lateral side of the miniature lamp, being made of a semi-transparent material and containing a light storing material. According to still another aspect of the present invention, a portable lighting device is provided, which comprises a battery casing, a miniature lamp holder mounted near an end of the battery casing, and a miniature lamp mounted on the miniature lamp holder, whereby the miniature lamp holder is made of synthetic resin, which contains a light storing material.

14 Claims, 9 Drawing Sheets

PORTABLE LIGHTING DEVICE

BACKGROUND OF THE INVENTION

1. Field of the Invention

The present invention relates to a portable lighting device, and in particular to a portable lighting device, which utilizes absorption and release of light energy by a light storing agent and can be used for lighting in dark place or at nighttime.

2. Description of the Prior Art

In the past, various types of portable lighting device have been developed and used in practical application. In general, a portable lighting device as described above comprises a battery, a miniature electric lamp, a cylindrical casing, a switch, a reflection plate (or dish), a transparent sealing material, etc. In the conventional type portable lighting device as described above, the switch is turned on, and light is emitted from the miniature lamp and lighting is provided only during the period when electric power is connected to the miniature lamp. Some of the conventional type portable lighting devices contain a light storing material so that, even after the power is turned off by switch, light energy absorbed and stored by the light storing material is released, thus providing lighting to the surroundings. A portable lighting device utilizing the light storing material is disclosed in U.S. Pat. No. 4,546,416 (Pemberton). In this U.S. patent, a bezel or a rim around a lens, used as a sealing material and arranged in front of the miniature lamp, is made of semi-transparent synthetic resin, and a light storing material is added when the synthetic resin is molded.

Consequently, the ring-like bezel absorbs light from the miniature lamp, and even after the miniature lamp is turned off, light is emitted from the bezel and provides lighting to the surroundings.

However, there is limitation to the volume of the ring-like bezel because of its shape and function, and hence, there is also limitation to total amount of the light storing material. For this reason, after the switch is turned off on the portable lighting device, the time of light emission from the light storing material is very short.

In the conventional portable lighting device, considerable degree of illuminance can be obtained when switch is turned on and light is emitted from the miniature lamp. However, when performing work in a dark room or, for example, when observing constellations of stars at night and it is wanted to see astronomical table or other material in the dark, the light with high illuminance is too dazzling and blinding to the user because pupils of human eyes are widely opened in the dark. When exposed to the light too dazzling, the pupils are extremely closed down. As a result, after switch is turned off on the portable lighting device, some time is required until the user becomes familiar with the dark place again. During this period, the user cannot, see anything around in the dark.

SUMMARY OF THE INVENTION

It is an object of the present invention to provide a portable light device, by which a light storing material in the device can absorb and store light of a miniature lamp and can emit light overnight thereafter, and the device has high lighting ability.

It is another object of the present invention to provided a portable lighting device, which can provide light with illuminance not so high as that of directly irradiated light from a miniature lamp but with illuminance enough to read materials and to perform work when the user becomes familiar with dark place, and the user can adapt eyes promptly so that the user can see the object even in the dark when the lighting has been moved away.

According to one aspect of the present invention, the portable lighting device of the invention comprises a battery casing, a miniature lamp mounted near an end of the battery casing, and a shielding plate arranged at a position separated from the miniature lamp in axial direction of the battery casing and being made of a semi-transparent material disposed to shield front side and lateral side of the miniature lamp, and containing a light storing material.

According to another aspect of the present invention, the portable lighting device of the invention comprises a battery casing, a miniature lamp mounted near an end of the battery casing, and a cylindrical member extended from the end of the battery casing where the miniature lamp is mounted in axial direction of the battery casing, disposed to shield front side and lateral side of the miniature lamp, being made of a semi-transparent material and containing a light storing material.

According to still another aspect of the present invention, the portable lighting device of the invention comprises a battery casing, a miniature lamp holder mounted near an end of the battery casing, and a miniature lamp mounted on the miniature lamp holder, whereby the miniature lamp holder is made of synthetic resin, which contains a light storing material.

As the light storing material in the present invention, alloy crystals composed of $SrAl_2O_4$ is preferably used. This light storing material is known as a light-storing pigment and is disclosed in U.S. Pat. No. 5,424,006. By adding this light storing material to a moldable synthetic resin by 3 to 30 weight %, it is possible that light is continuously emitted even for considerably long time after the miniature lamp is turned off.

When this light storing material is used, light can be emitted for long time after the miniature lamp is turned off. Because illuminance is decreased as time elapses, it is more advantageous to provide an intermittent driving circuit to intermittently turn on and off the miniature lamp as necessary in order to store light and to emit light alternately and to maintain high illuminance.

Further, if there is provided time adjusting means for adjusting intermittent cycle to turn on and off the lamp intermittently, it is possible to set the intermittent cycle as desired.

BRIEF DESCRIPTION OF THE DRAWINGS

In the following, detailed description will be given on the present invention in connection with the embodiments shown in the attached drawings.

DETAILED DESCRIPTION OF THE PREFERRED EMBODIMENTS

1st Embodiment

Figure 1:
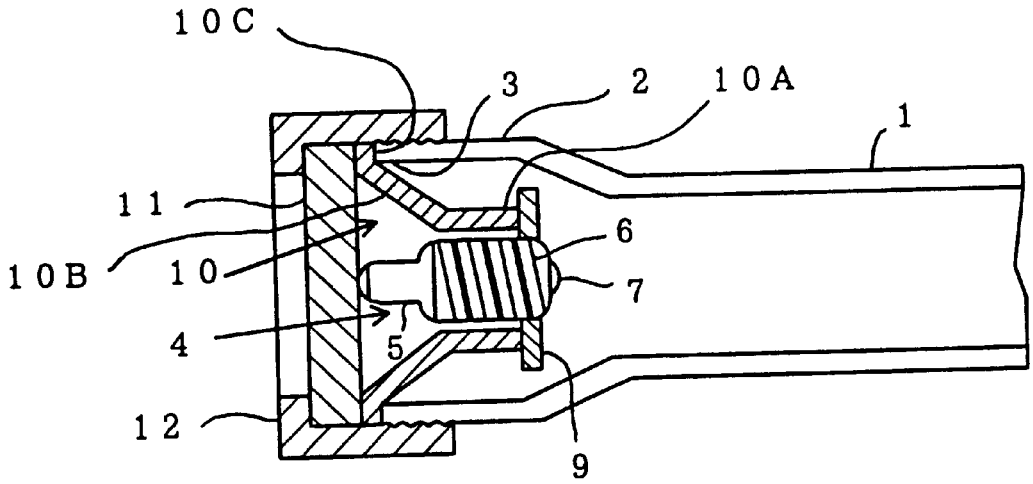
FIG. 1 is a lateral sectional view of a first embodiment of a portable lighting device of the present invention.
Figure 2:
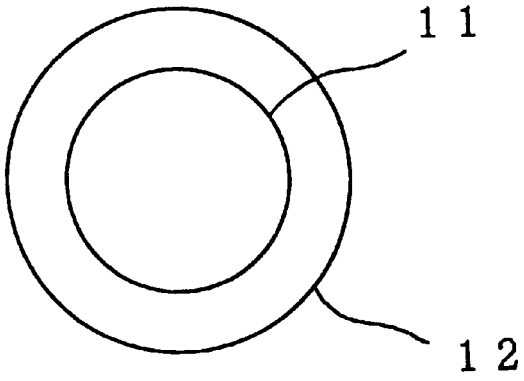
FIG. 2 is a plan view of the first embodiment of the portable lighting device of the present invention.

FIG. 1 is a lateral sectional view of a first embodiment of a portable lighting device of the present invention, and FIG. 2 is a plan view (as seen from left side of the FIG. 1) of the first embodiment. The portable lighting device shown in FIG. 1 is a flashlight and comprises a battery casing in hollow cylindrical shape, a reflection plate 10, a miniature lamp 4, a shielding plate 11 and a fastening cap 12. The battery casing 1 is equipped with a switch not shown in FIG. 1. By this switch, voltage from a dry battery (not shown) accommodated in the battery casing 1 is selectively applied between a screw base of the miniature lamp 4 and a connecting terminal 7. The screw base 6 of the miniature lamp 4 is engaged with and held by inner periphery of a cylindrical portion 10A of the reflection plate 10. At an end of the cylindrical portion 10A, an annular metal plate 9 is provided, which is brought into electrical contact with the screw base 6 of the miniature lamp 4. The reflection plate 10 comprises a tapered portion 10B, which is extended in conical shape toward outer periphery from the cylindrical portion 10A. That is, the reflection plate 10 is designed in shape of a dish or a dome as a whole, and this is also referred as a dish-like member hereinafter. Outer peripheral end of the tapered portion 10B is continuous with a flange 10C. The battery casing 1 has larger diameter on its portion near one end thereof, and an opening 3 is provided at this end. The portion with larger diameter of the casing forms a lamp receptacle 2 at the forward end. The reflection plate 10 may be made of aluminum metal such as lustrous aluminum, which may be made of synthetic resin and may be provided with metal luster on the surface by plating process.

The flange 10C of the reflection plate 10 is sandwiched between the forward opening 3 of the battery casing 1 and. the semi-transparent shielding plate 11. The shielding plate 11 is made of acrylic resin and contains a light storing material by 10 weight % where the light storing material has alloy crystals composed of $SrAl_2O_4$. As the light storing material as described above, "N Yako" as manufactured and marketed by Nemoto Special Chemistry Co., Ltd. (Suginamiku, Tokyo) may be used. The light storing material is excited by light with wavelength of 250 to 400 nm. Then, light is stored, and light in light-yellowish green in color with wavelength around 520 nm is emitted with high brightness. In this light storing material, when illuminance of illuminating light is 200 1x, excitation time up to 80% of saturation is 10 minutes. In the present embodiment, when the shielding plate 11 is 20 mm in diameter and 3 mm in thickness and the miniature lamp 4 is turned on with battery voltage of 3 V and current of 0.25 A, light is stored in sufficient degree even when the lamp is turned on only for several seconds. For 10 minutes or more after the lamp is turned off, it is possible to have such illuminance that objects in the surrounding can be seen. Illuminance is decreased thereafter, but illuminance of a certain degree clan be maintained for several hours in the dark.

As the shielding plate 11, in addition to the acrylic resin, the following materials may be used: ABS, vinyl chloride, polyethylene, polycarbonate, etc. The content of the light storing material can be set to 3 to 30 weight %. Preferably, the shielding plate 11 is designed with thickness of 3 mm or more because light storing capacity is influenced by the thickness of the shielding plate.

The ring-like fastening cap 12 is engaged with the battery casing 1, and the shielding plate 11 is held and filled by the cap 12. As it is evident from FIG. 1, the shielding plate 11 is provided instead of a transparent cover plate or a lens in a conventional type flashlight. Because the shielding plate itself is semi-transparent, even when the miniature lamp 4 is emitting light, direct light from the miniature lamp 4 is not irradiating toward outside as in case of a conventional type flashlight. Namely, slightly reddish light beam coming from the miniature lamp 4 is turned to nearly white light after passing through the semi-transparent shielding plate 11, and soft light is irradiated toward outside.

To contain sufficient amount of the light storing material, as shown in FIG. 1, the shielding plate 11 is designed as thicker than the cover plate or the lens, which serves as mere partition member in the conventional type product. Therefore, the present embodiment can continuously emit light for longer time than the conventional type portable lighting device, which comprises a member containing the light storing material. When the miniatures lamp 4 is turned off, light energy stored in the light storing material is emitted as phosphorescence or afterglow. The color of the emitted light is light-yellowish green.

2nd Embodiment

Figure 3:
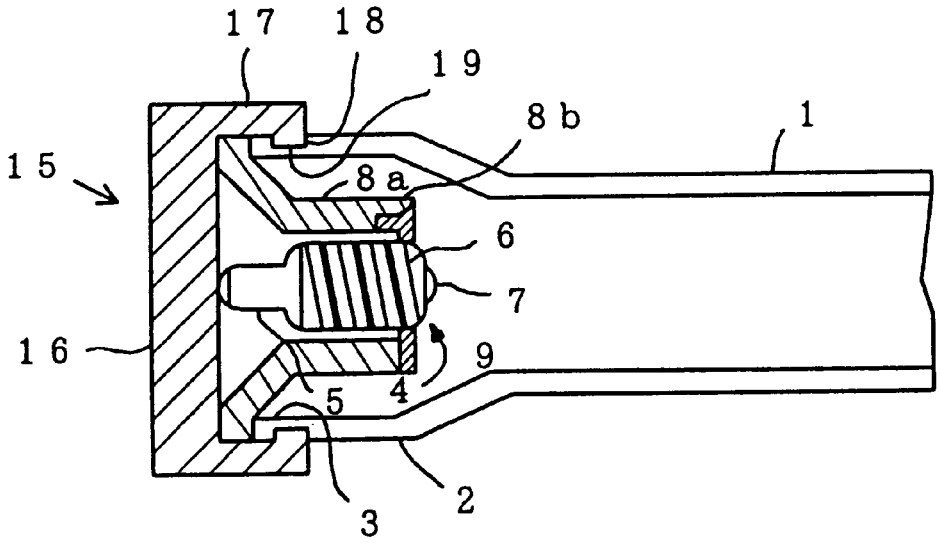
FIG. 3 is a lateral sectional view of a second embodiment of the portable lighting device of the present invention.
Figure 4:
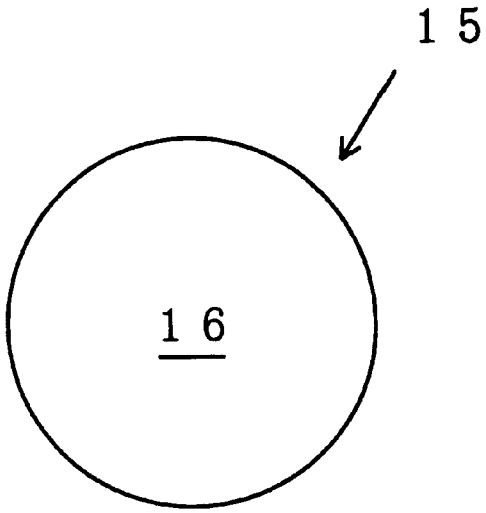
FIG. 4 is a plan view of the second embodiment of the portable lighting device of the present invention.

FIG. 3 is a lateral sectional view of a second embodiment of the portable lighting device of the present invention, and FIG. 4 is a plan view (seen from left side of FIG. 3) of the second embodiment. The portable lighting device shown in FIG. 3 is a flashlight similar to that of FIG. 1. The same or the corresponding member as in the first embodiment is referred by the same reference numeral. In the following, description will be given mainly on the features different from those of the first embodiment. In the second embodiment, the shielding plate 11 and the ring-like cap 12 as shown in the first embodiment are integrally molded. Specifically, the shielding plate 16 comprises an annular sector 17 extending in axial direction of the battery casing 1 near its outer periphery. On inner periphery of the annular sector 17, an engaging projection 18 slightly protruding inwardly in radial direction is integrated. By removably engaging this engaging projection 18 in an engaging groove 19, which is arranged on outer periphery near the forward opening 3 of the battery casing 1, the annular sector 17 of the integrated shielding plate 16 is mounted on the battery casing 1. It can be designed in such manner that both the shielding plate 16 and the annular sector 17 contain the light storing material. The integrated shielding plate 16 and the annular sector 17 constitute a cap member 15.

Further, in the second embodiment, the miniature lamp 4 is not held by the reflection plate 10, but there is provided a miniature lamp holder 8*a*, which is designed in conical shape similar to the reflection plate 10 and has a tapered portion. Specifically, the miniature lamp holder 8*a* is designed in dish-like or dome-like shape as in the first embodiment, but it does not reflect light. The miniature lamp holder 8*a* is made of synthetic resin and is molded in advance to contain the light storing material as in the case of the shielding plate 16. To increase the light storing ability, it is preferable that the miniature lamp holder 8*a* is designed thicker in dimension to some extent. The thickness is preferably 3 mm or more. The miniature lamp 4 is held by a cylindrical portion 8*b* of the miniature lamp holder 8*a*. An annular metal plate 9 is mounted at an end of the cylindrical portion 8*b* so that it is brought into contact with the screw base 6 of the miniature lamp 4. The metal plate 9 is designed as electrically connectable to a connection piece (not shown).

The above embodiment has the shielding plate 11 and the ring-like cap 12 integrated with each other, and further, the miniature lamp holder 8*a* contains the light storing material. The reflection plate 10 as in the first embodiment may be combined instead of the miniature lamp holder 8*a*.

3rd Embodiment

Figure 5:
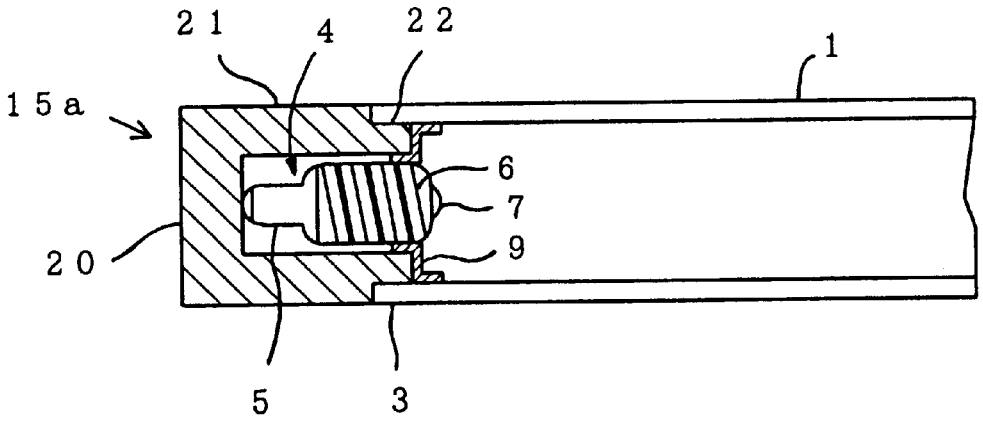
FIG. 5 is a lateral sectional view of a third embodiment of the portable lighting device of the present invention.
Figure 6:
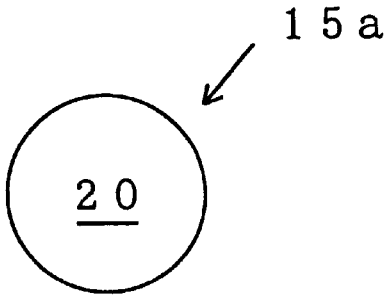
FIG. 6 is a plan view of the third embodiment of the portable lighting device of the present invention.

Next, description will be given on a third embodiment of the invention. FIG. 5 is a lateral sectional view of the third embodiment of the portable lighting device of the present invention, and FIG. 6 is a plan view (seen from left side of FIG. 5) of the third embodiment. The portable lighting device as shown in FIG. 5 is a flashlight similar to the one shown in FIG. 2, and the same member or the corresponding member as in the second embodiment is referred by the same symbol. In the following, description will be given on the features different from those of the second embodiment. In the third embodiment, the integrated structure of the shielding plate 11 and the ring-like cap 12 in the second embodiment, i.e. a cap member 15*a*, also fulfills the function as the miniature lamp holder. The cap member 15*a* of the third embodiment is designed as a cup-like member having U-shaped cross-section. The cap member 15*a* comprises a lateral portion (circumferential portion) 21 and a front portion (bottom of the cap) 20 integrally molded at one end. On inner periphery of the lateral portion 21 of the cap member 15*a*, a screw base 6 of the miniature lamp 4 is retained. Near an end of the lateral portion 21, an annular metal plate 9 similar to that of the second embodiment is provided. On outer periphery near the end of the lateral portion 21, an engaging sector 22 having slightly smaller outer diameter is arranged, and this engaging sector 22 is engaged with inner periphery of the end of the battery casing 1.

Unlike the first and the second embodiments, in the third embodiment, members containing the light storing material, i.e. the lateral portion 21 and the front portion 20 of the cap member 15*a*, are disposed immediately adjacent to a light emitting portion 5 of the miniature lamp 4. Accordingly, it is possible to absorb light energy emitted from the light emitting portion 5 and to store the light.

4th Embodiment

Figure 7:
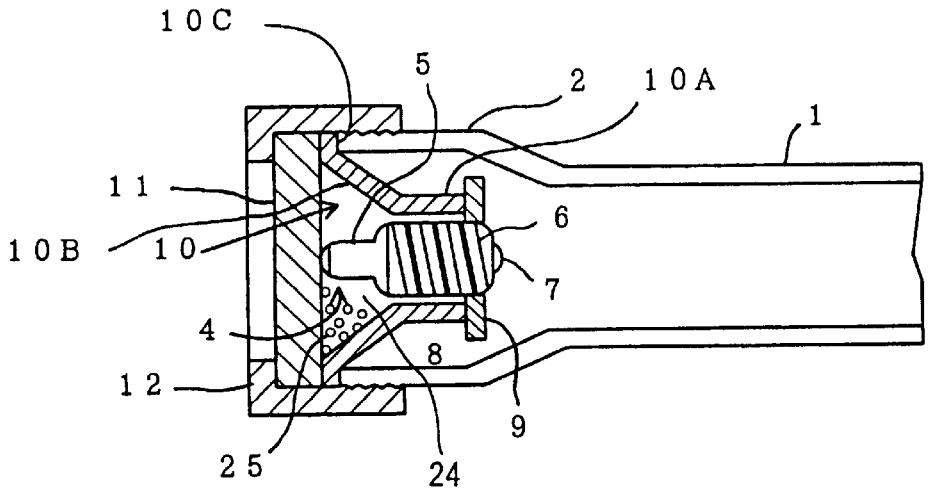
FIG. 7 is a lateral sectional view of a fourth embodiment of the portable lighting device of the present invention.
Figure 8:
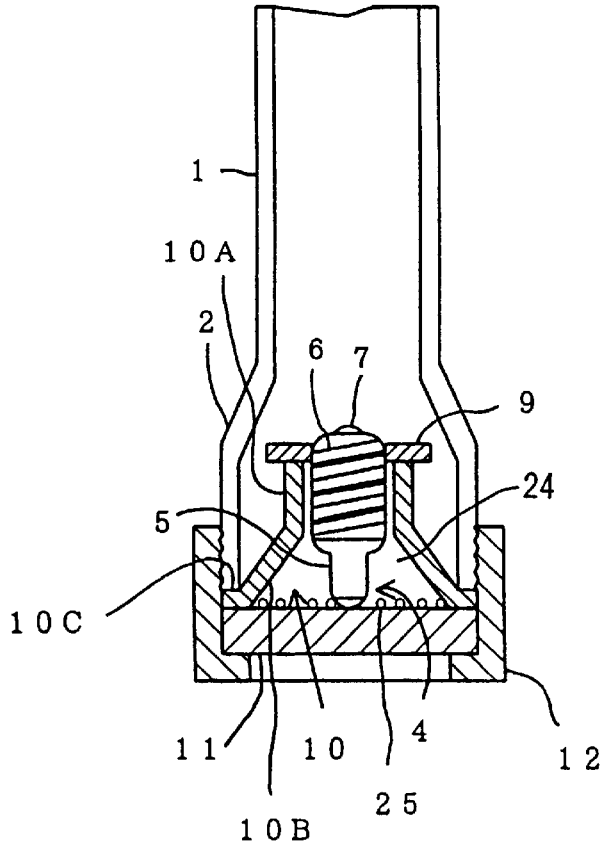
FIG. 8 is a plan view of the fourth embodiment of the portable lighting device of the present invention.

FIG. 7 is a lateral sectional view of a fourth embodiment of the invention. The fourth embodiment is designed as a variation of the first or the second embodiments described above. Here, it is explained as a variation of the first embodiment, and description will be given only on the features different from those shown in FIG. 1. In FIG. 7, synthetic resin powder 25 containing the light storing material as described above is disposed in a space 24 in conical shape, which is defined by the reflection plate 10 and the shielding plate 11. When the portable lighting device is at horizontal position as shown in FIG. 7, the synthetic resin powder 25 is gathered near the lower portion of the flange 10C. On the other hand, when the portable lighting device is placed with the shielding plate 11 facing downward as shown in FIG. 8, the synthetic resin powder 25 is positioned on inner surface of the shielding plate 11. When the miniature lamp 4 is turned on under this condition, light energy is absorbed by the synthetic resin powder 25, which is evenly scattered on the shielding plate 11.

When the user begins to watch outdoors at night and tries to see an astronomical table, for example, sufficient illuminance can be obtained by holding the portable lighting device of the fourth embodiment as shown in FIG. 8 with its shielding plate 11 facing downward and by illuminating the astronomical table. In the fourth embodiment, higher illuminance can be attained than in the first embodiment because light is irradiated from both the shielding plate 11 and the synthetic resin powder 25.

Instead of the synthetic resin powder 25, particles or pellets containing the light storing material may be used.

5th Embodiment

Figure 9:
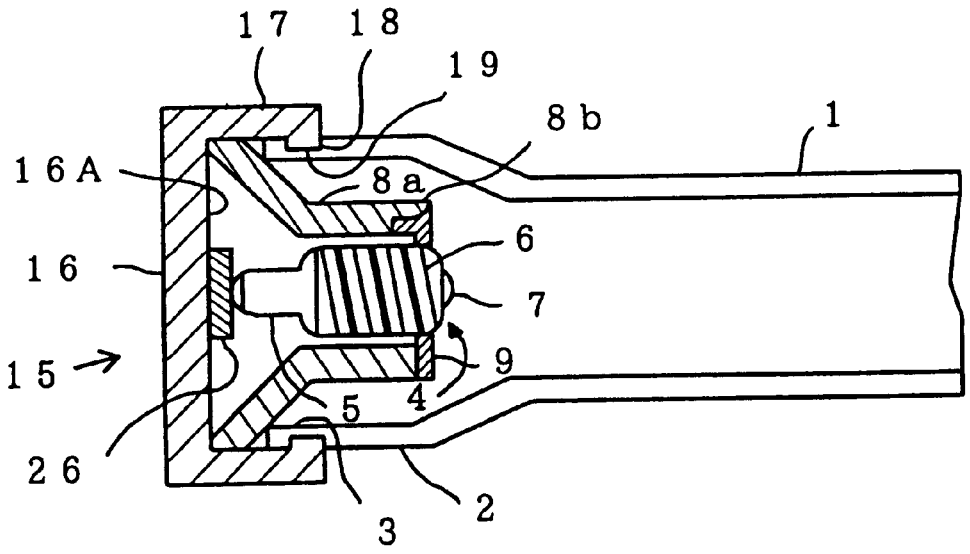
FIG. 9 is a lateral sectional view of a fifth embodiment of the portable lighting device of the present invention.
Figure 10:
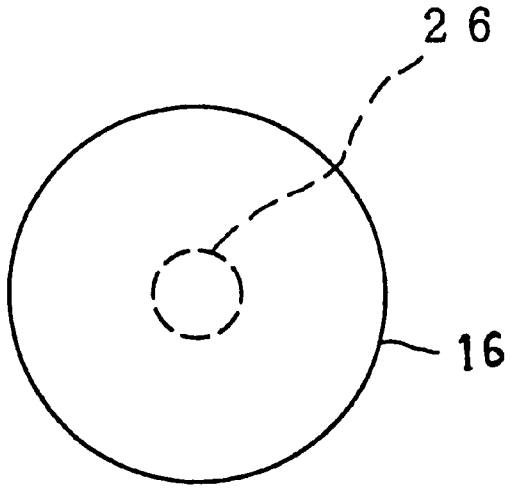
FIG. 10 is plan view of the fifth embodiment of the portable lighting device of the present invention.

FIG. 9 is a lateral sectional view of a fifth embodiment of the invention, and FIG. 10 is a plan view (see from left side of FIG. 9) of the fifth embodiment. The fifth embodiment is designed as a variation of the first or the second embodiments as described above. Here, it is explained as a variation of the second embodiment, and description will be given only on the features different from those of FIG. 3. In FIG. 9, on inner surface 1 1A of the shielding plate 11, a circular plate 26 is attached using adhesive. Like the shielding plate 11, the circular plate 26 is made of synthetic resin and contains the light storing material. In the fifth embodiment, the shielding plate 11 is designed to be thicker at the center in order to increase absorption of light energy on portions immediately adjacent to the light emitting portion 5 of the miniature lamp 4. Therefore, instead of attaching the circular plate 26 as shown in FIG. 9, the central portion of the shielding plate 11 may be designed thicker.

6th Embodiment

Figure 11:
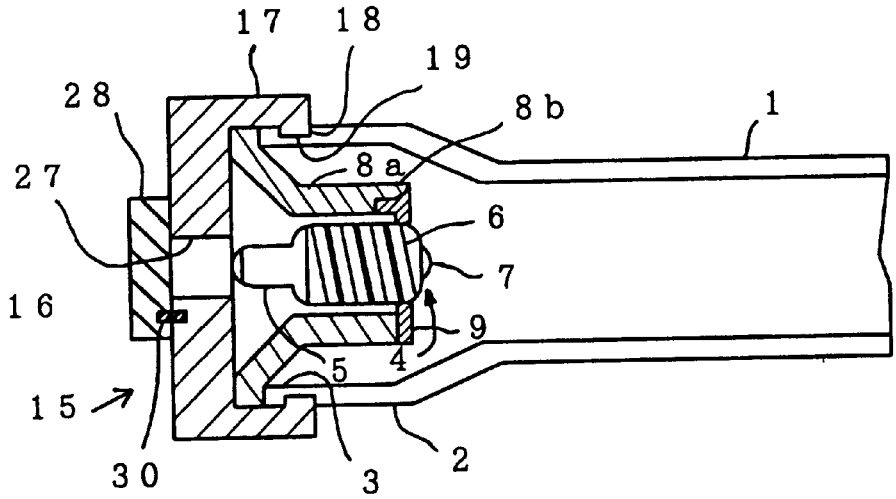
FIG. 11 is a lateral sectional view of a sixth embodiment of the portable lighting device of the present invention.
Figure 12:
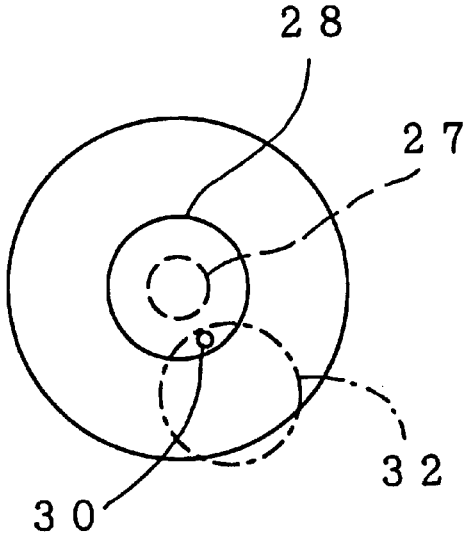
FIG. 12 is a plan view of the sixth embodiment of the portable lighting device of the present invention.

FIG. 11 is a lateral sectional view of a sixth embodiment, and FIG. 12 is a plan view (seen from left side of FIG. 10) of the sixth embodiment. The sixth embodiment is designed as a variation of the first or the second embodiments as described above. Here, it is explained as a variation of the second embodiment, and description will be given only on the features different from those of FIG. 2. In FIG. 11, an opening 27 is provided to penetrate the shielding plate 11 approximately at its central portion. The opening 27 can be closed by a circular lid 28, which is pivotally and rotatably supported by a pin 30 on outer surface of the shielding plate 11. FIGS. 11 and 12 show the conditions where the opening 27 is completely covered and closed by the circular lid 28.

As shown by one-dot chain line in FIG. 12, the circular lid 28 can be rotated around the pin 30. When the user moves it from the position shown by solid line to the position shown by one-dot chain line, it is possible to expose the opening 27 and to release the light from the light emitting portion 5 of the miniature lamp 4 directly toward outside.

Specifically, the sixth embodiment can be provided in the following two conditions: the condition where sufficient brightness can be attained when the miniature lamp 4 is turned on (the circular lid 28 is moved to open and expose the opening 27) as in case of a conventional type flashlight, and the condition where weak light from the light emitted from the shielding plate 11 containing the light storing material can be obtained when the miniature lamp 4 is turned off (the circular lid 28 is moved to close and block the opening 27). A spring member may be incorporated in the circular lid 28 so that the opening 27 can be moved by snap action between two positions, i.e. the position where the opening 27 is completely blocked and the position where it is completely exposed.

7th Embodiment

Figure 13:
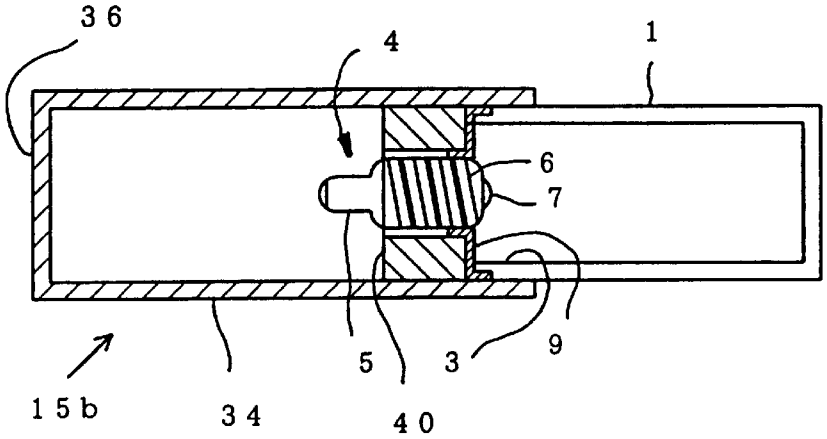
FIG. 13 is a lateral sectional view of a seventh embodiment of the portable lighting device of the present invention.

FIG. 13 is a lateral sectional view of a seventh embodiment of the invention. The seventh embodiment is designed as a variation of the third embodiment as described above. Here, description will be given only on the features different from those of FIG. 5. In FIG. 13, on the forward end of the battery casing 1, a cylindrical member 15*b* with a length approximately equal to or longer than the length of the battery casing 1 is mounted. Like the cap member 15 of FIG. 3, the cylindrical member 15*b* is made of synthetic resin which contains the light storing material, and it comprises a lateral portion 34 and a front portion 36 integrally molded together. At a position closer to the battery casing 1 inside the cylindrical member 15*b*, a miniature lamp holder 40 is disposed.

On a pen type flashlight as shown in FIG. 3, in which the miniature lamp is turned on using two dry batteries, i.e. with voltage of 3 V, the present inventor has performed experiment to determine when the light storing ability is lost, i.e. at which point the member containing the light storing material is separated from the light emitting portion 5 of the miniature lamp 4. In this experiment, instead of the cap member 15*a* of FIG. 3, a cylindrical portion of 35 cm in length and made of the similar material was mounted, and the miniature lamp was turned on for 5 minutes in a dark room. Then, the lamp was turned off, and light emitting condition was visually confirmed 15 minutes after the lamp was turned off. As a result, it was confirmed that the light was at the brightest near the light source and it was weak at the forward end, i.e. 35 cm from the light source, and that brightness gradually increased from the forward end of the member toward the light source. On the portion of the cylindrical member at about 12 cm from the light source, there was brightness enough to visually confirm a map in a dark room, and it was found that the range suitable for practical use was up to about 12 cm.

As it is evident from the result of the above experiment, if the cap member 15*a* of FIG. 3 is extended in axial direction and it is used in the length of about 12 cm, the volume of the portion to release light from the light storing material can be extensively increased compared with the third embodiment. The portable lighting device according to the seventh embodiment with the above arrangement can be used as a signal light used for traffic guidance at nighttime or as a light for guiding audience in theater.

8th Embodiment

Figure 14:
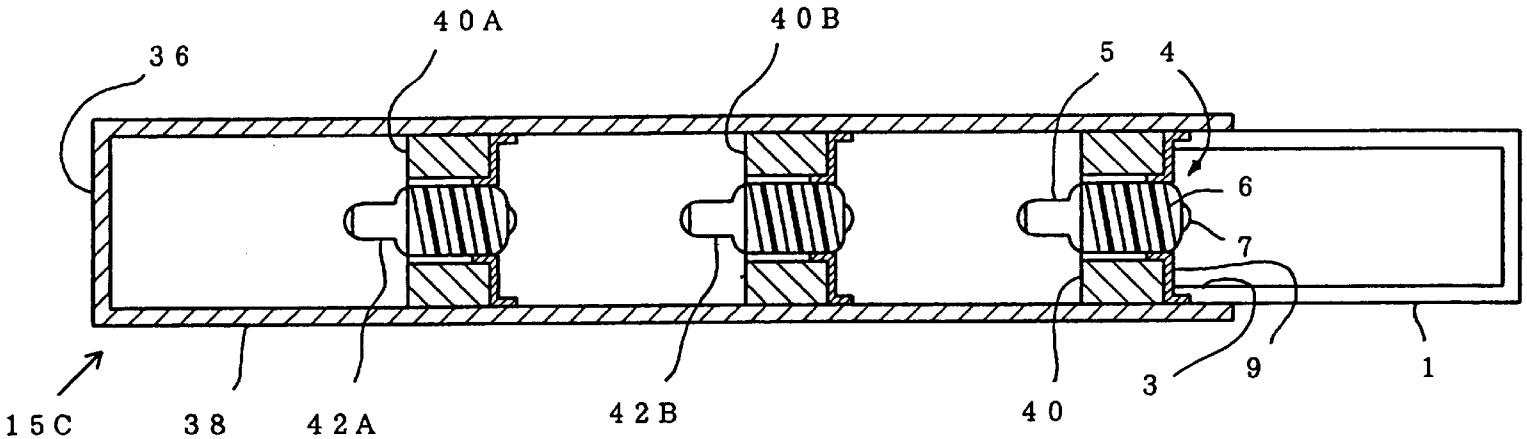
FIG. 14 is a lateral sectional view of an eighth embodiment of the portable lighting device of the present invention.

FIG. 14 is a lateral sectional view of an eighth embodiment. The eighth embodiment is designed as a variation of the seventh embodiment as described above. Here, description will be given on the features different from those of FIG. 13. In FIG. 14, a cylindrical member 15*c* is designed with a length about three times as long as the length of the cylindrical member 15*b* of FIG. 13, and there are provided partition plates 40A and 40B, serving as miniature lamp holders, separated by about 12 cm respectively. The cylindrical member 15*c* comprises a lateral portion 38 and a front portion 36, and the partition plates 40A and 40B are arranged on inner periphery of the lateral portion in such manner as to divide the internal space. On the partition plates 40A and 40B, miniature lamps 42A and 42B are mounted respectively and are connected in parallel to an electrode of the miniature lamp 4 via connecting means (not shown).

The eighth embodiment has the same arrangement as the seventh embodiment except that a combination of the! miniature lamp 4 and the cylindrical member 15*b* is connected in 3-stage series. In this embodiment, these are positioned in 3-stage arrangement, while the number of stages may be increased further to have longer light emitting portion. In the eighth embodiment, a miniature lamp is arranged at each stage, and the length of the lateral portion 38 in each stage is about 12 cm. Thus, the total length can be made much longer than in the seventh embodiment while maintaining high light storing ability in each stage.

In the eighth embodiment, a plurality of miniature lamps are connected in parallel, and even when some of the miniature lamps is disconnected, it is possible to guarantee the light storing at the portion where there are other miniature lamps. In the seventh and the eighth embodiments as described above, the front portion 36 is integrally molded with the lateral portion 34, while the area of the lateral portion 34 is considerably larger than the area of the front portion 36 in these embodiments, and it is mostly in lateral portion 34 that the light is substantially stored and emitted. Therefore, the front portion 34 may not be integrally molded with the lateral portion 34, and it may be designed in such manner that the lateral portion 34 is arranged as the cylindrical portion and an adequate circular member may be provided on a portion corresponding to the front portion 36.

9th Embodiment

Figure 15:
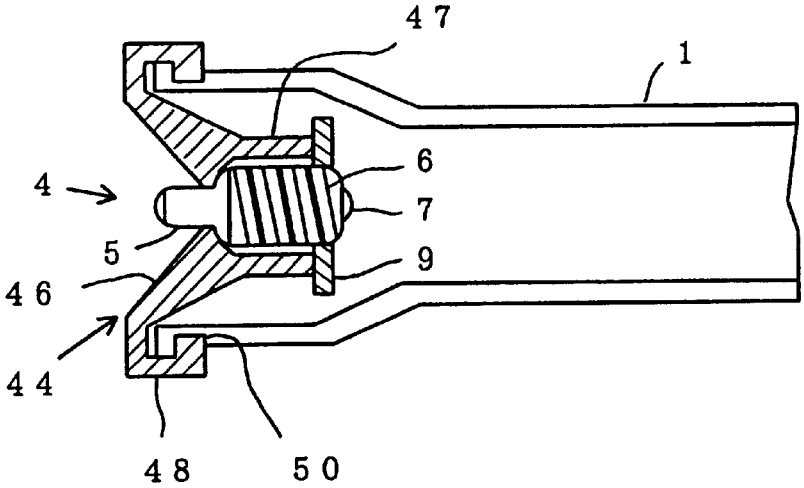
FIG. 15 is a lateral sectional view of a ninth embodiment of the portable lighting device of the present invention.

FIG. 15 is a lateral sectional view of a ninth embodiment. Unlike the embodiments described above, the miniature lamp 5 is opened to outside, and there is no member, which corresponds to the shielding plate 11. In a sense, the ninth embodiment is similar to the second embodiment of FIG. 3, and the miniature lamp holder 44 is made of synthetic resin which contains a light storing material. It comprises a tapered portion 46 so that it is in conical shape as a whole. The miniature lamp holder 44 in the ninth embodiment has a flange 48 and an engaging sector 50 continuous to it so that the holder can be engaged with the forward end of the battery casing 1. On inner periphery of the tapered portion 46, a cylindrical portion 47 is provided, and these are integrated together. At the end of the cylindrical portion 47, an annular metal plate 9 is attached in such manner that it is brought into contact with the screw base 5 of the miniature lamp 4.

In the ninth embodiment, when the miniature lamp 4 is turned on, the light from it is absorbed by the miniature lamp holder 44 and the light is stored. Therefore, when the miniature lamp 4 is turned on, it can be used as a normal type flashlight. After it is turned off, adequate illuminance can be attained in the dark by the light emitted from the light storing material as in the case of the first to the eighth embodiments.

10th Embodiment

Figure 16:
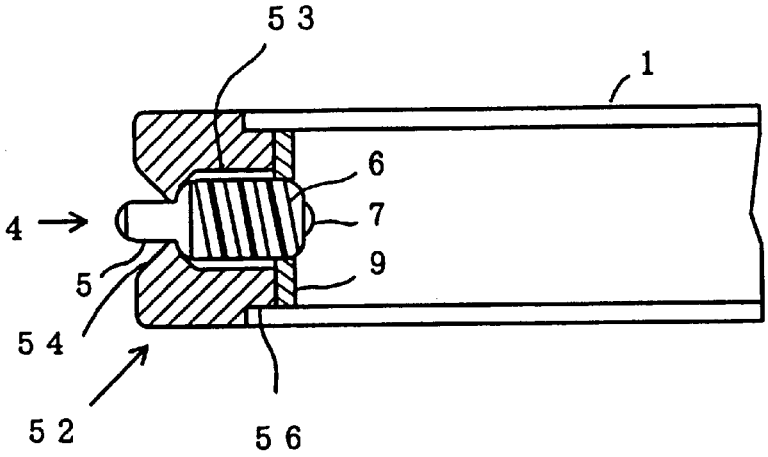
FIG. 16 is a lateral sectional view of a tenth embodiment of the portable lighting device of the present invention.

FIG. 16 is a lateral sectional view of a tenth embodiment. The tenth embodiment is a variation of the ninth embodiment as described above, and it is also a variation of the third embodiment. Specifically, except the forward end of the miniature lamp holder in the third embodiment as shown in FIG. 5, the miniature lamp is opened to outside as in the ninth embodiment of FIG. 15. The miniature lamp holder 52 in the tenth embodiment comprises an inner peripheral portion 53 for holding the miniature lamp 4 and a tapered portion 54 which is spread in conical shape from the inner peripheral portion 53. The miniature lamp holder 52 is designed thicker as in the case of the third embodiment. A portion of the miniature lamp holder 52 has smaller outer diameter near one end of the outer peripheral portion so that an insert 56 is formed, and the insert 56 can be engaged with the inner peripheral portion at one end of the battery casing 1.

The third, the ninth and the tenth embodiments as described above have simple design that a miniature lamp holder is mounted at the forward end of the battery casing 1 and the miniature lamp 4 is retained by the holder. As a. result, the number of parts used is fewer than in the conventional type portable lighting device, and this makes it possible to provide the portable lighting device at lower cost.

Figure 17:
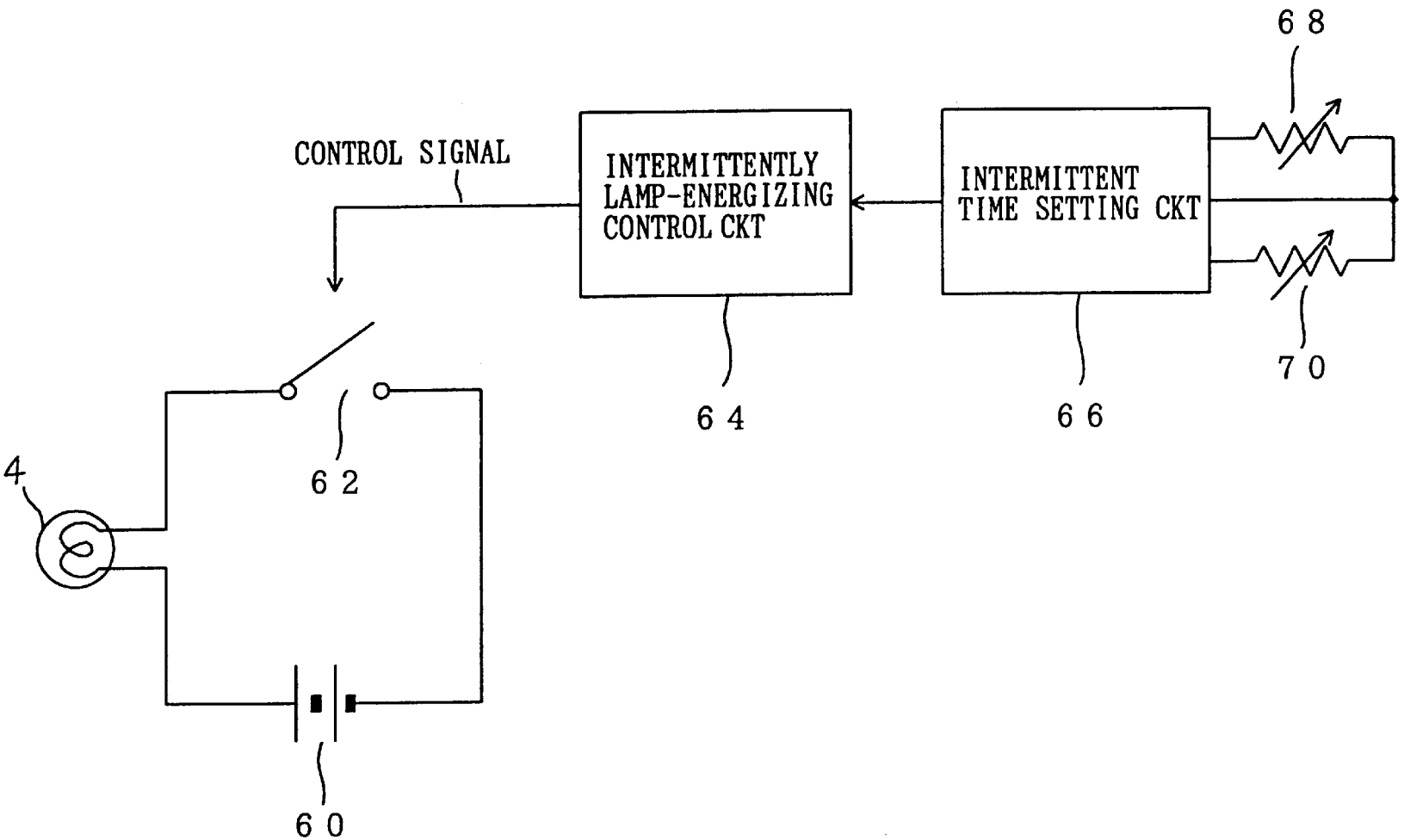
FIG. 17 represents a circuit diagram of an electrical circuit for intermittently turning on and off the device, which can be preferably incorporated in the portable light device of the present invention.

In the above embodiments, description has been given on such design that the miniature lamp 4 is manually controlled by turning it on and off using a switch. To make the portable lighting device of the present invention more convenient, it is preferable that the miniature lamp 4 can be turned on and off intermittently. FIG. 17 represents an example of circuit arrangement to turn the miniature lamp 4 on and off intermittently. Both electrodes of the miniature lamp 4 are connected to a series circuit of a switch 62 and a battery 60. The switch 62 is a relay or a semiconductor switch, and on-off operation thereof is controlled by a control signal from an intermittently lamp-energizing control circuit 64. The intermittently lamp-energizing control circuit 64 may be designed, for example, as a mono-stable multi-vibrator, which is in on state for a fixed period of time and is in off state for another fixed period of time, where the on and off states repeat with a fixed cycle. To the intermittently lamp-energizing control circuit 64, an intermittent time setting circuit 66 is connected. By manually operating a variable resistor 68, it is possible to set the time of one cycle as desired. Also, by manually operating a variable resistor 70, it is possible to set the "on" time (time period of on state of the lamp ) in one cycle. For example, if it is supposed that one cycle lasts for 30 minutes and the "on" time lasts for 5 minutes, the miniature lamp 4 is automatically turned on, and keeps the on state for 5 minutes at every 30-minutes. As a result, the member containing the light storing material can absorb light energy, and this is very advantageous when high illuminance is needed for long time.

As described above, according to the present invention, a member containing the light storing material is arranged near a miniature lamp and efficiently absorbs light energy coming from the miniature lamp and stores light. Therefore, it is possible to continuously emit the light for long time after the lamp has been turned off. By increasing the volume of a synthetic resin molded product for emitting light with low illuminance from the light storing material, it is possible to obtain illuminance enough to visually confirm work or material in the dark. Also, when the portable lighting device of the present invention is moved away from the user, the eyes of the user can immediately adapt to the surrounding darkness and the user can continue the work.

The portable lighting device of the present invention has such superb effect that illuminance as needed can be obtained without making trouble to those around it in the case where it is necessary to light up the floor at user's feet in hotel, hospital or in a room at nighttime or the case where it is wanted to write on a memorandum in bed room at night.

As it is evident from the above embodiments, the member containing the light storing material in the present invention has larger surface area than the miniature lamp. Thus, after the miniature lamp has been turned off, the light emitting material is turned to a surface light source. As a result, the user does not feel dazzling when watching at the light emitting portion, and it is possible to obtain illuminance enough to write or to perform other work.

In the above embodiment, the present invention has been explained in several aspects, while it is needless to say that various variations, modifications or design changes can be made without departing from the description of the claims of the invention, and these changes and modifications naturally fall within the scope of the present invention.

What is claimed is:

1. A portable lighting device comprising:

a battery casing;

a miniature lamp mounted near an end of said battery casing; and a shielding plate arranged in such a manner as to shield a front side of said miniature lamp at a position separated from the miniature lamp in an axial direction of said battery casing, said shielding plate being made of a semi-transparent material and containing a light storing material wherein said miniature lamp is retained by a dish-shaped member and said dish-shaped member contains a light storing material.

2. A portable lighting device comprising:

a battery casing;

a miniature lamp mounted near an end of said battery casing; and a shielding plate arranged in such a manner as to shield a front side of said miniature lamp at a position separated from the miniature lamp in an axial direction of said batter casing, said shielding plate being made of a semi-transparent material and containing a light storing material;

wherein said miniature lamp is retained by a dish-shaped reflection plate; and wherein there are provided a plurality of synthetic resin particles containing a light storing material in a space defined by said dish-shaped reflection plate and said shielding plate.

3. A portable lighting device comprising:

a battery casing;

a miniature lamp mounted near an end of said battery casing; and a shielding plate arranged in such a manner as to shield a front side of said miniature lamp at a position separated from the miniature lamp in an axial direction of said batter casing, said shielding plate being made of a semi-transparent material and containing a light storing material;

wherein said miniature lamp is retained by a dish-shaped member and said dish-shaped member contains a light storing material; and wherein there are provided a plurality of synthetic resin particles containing a light storing material in a space defined by said dish-shaped member and said shielding plate.

4. A portable lighting device comprising:

a battery casing;

a miniature lamp mounted near an end of said battery casing; and a shielding plate arranged in such a manner as to shield a front side of said miniature lamp at a position separated from the miniature lamp in an axial direction of said batter casing, said shielding plate being made of a semi-transparent material and containing a light storing material; and wherein an opening is arranged near the central portion of said shielding plate, and there is provided a movable plate, which blocks said opening when it is at a first position and keeps said opening opened when it is at a second position.

5. A portable lighting device according to claim 4, wherein said movable plate is made of a semi-transparent synthetic resin, which contains a light storing material.

6. A portable lighting device, comprising:

a battery casing;

a miniature lamp holder mounted near an end of said battery casing; and a miniature lamp mounted on said miniature lamp holder, whereby:

said miniature lamp holder is made of a synthetic resin containing a light storing material.

7. A portable lighting device according to claim 6, wherein said miniature lamp holder comprises a conical tapered portion arranged near a light emitting portion of said miniature lamp.

8. A portable lighting device according to claim 6, wherein said miniature lamp holder comprises a flange, inner peripheral portion of said flange being engaged with outer periphery of said battery casing.

9. A portable lighting device according to claim 6, wherein a part of outer peripheral portion of said miniature lamp holder is engaged with inner periphery of said battery casing.

10. A portable lighting device according to claim 9, wherein said miniature lamp holder has a substantial thickness.

11. A portable lighting device according to claim 6, wherein said light storing material has alloy crystals composed of $SrAl_2O_4$.

12. A portable lighting device according to claim 6, further comprising an intermittent driving circuit for intermittently turning on and off said miniature lamp.

13. A portable lighting device according to claim 12, further comprising time adjusting means for adjusting an intermittent cycle for turning on and off said miniature lamp intermittently.

14. A pen type portable lighting device, comprising:

a battery casing;

a miniature lamp holder mounted near an end of said battery casing;

a miniature lamp mounted on said miniature lamp holder, whereby:

said miniature lamp holder has a portion surrounding a light emitting portion of said miniature lamp, and is made of a synthetic resin containing a light storing material.

* * * * *